US008162069B2

(12) United States Patent
Multer et al.

(10) Patent No.: US 8,162,069 B2
(45) Date of Patent: Apr. 24, 2012

(54) AUTOMATIC FIRE PROTECTION SPRINKLER WITH EXTENDED BODY

(75) Inventors: Thomas L. Multer, Westminster, SC (US); George S. Polan, Greer, SC (US)

(73) Assignee: The Reliable Automatic Sprinkler Co., Inc., Elmsford, NY (US)

( * ) Notice: Subject to any disclaimer, the term of this patent is extended or adjusted under 35 U.S.C. 154(b) by 253 days.

(21) Appl. No.: 11/470,093

(22) Filed: Sep. 5, 2006

(65) Prior Publication Data

US 2008/0053665 A1 Mar. 6, 2008

(51) Int. Cl.
*A62C 37/08* (2006.01)

(52) U.S. Cl. ..... 169/37; 169/38; 239/523

(58) Field of Classification Search ..... 169/37–41; 239/523

See application file for complete search history.

(56) References Cited

U.S. PATENT DOCUMENTS

| | | | | | |
|---|---|---|---|---|---|
| 269,930 | A | * | 1/1883 | Harris | 169/41 |
| 433,477 | A | * | 8/1890 | Lapham | 169/39 |
| 514,162 | A | * | 2/1894 | Newton | 169/39 |
| 575,121 | A | * | 1/1897 | Lapham | 169/39 |
| 691,760 | A | * | 1/1902 | Grinnell | 169/37 |
| 998,574 | A | | 7/1911 | Hamilton | |
| 2,180,258 | A | * | 11/1939 | Rowley | 169/41 |
| 2,697,008 | A | * | 12/1954 | Rowley | 239/498 |
| 2,724,614 | A | * | 11/1955 | Rider | 239/498 |
| 3,893,513 | A | * | 7/1975 | Marsh | 169/16 |
| 3,998,273 | A | * | 12/1976 | Juliano | 169/37 |
| 4,121,665 | A | * | 10/1978 | Woycheese | 169/38 |
| 4,136,740 | A | * | 1/1979 | Groos et al. | 169/39 |
| D251,128 | S | * | 2/1979 | Groos et al. | D23/214 |
| 4,279,309 | A | * | 7/1981 | Fischer et al. | 169/37 |
| 4,580,729 | A | * | 4/1986 | Pounder | 239/524 |
| 4,757,865 | A | * | 7/1988 | Simons | 169/39 |
| 4,957,169 | A | * | 9/1990 | Polan | 169/37 |
| 5,036,923 | A | * | 8/1991 | Shea, Sr. | 169/37 |
| 5,072,792 | A | | 12/1991 | Simons et al. | 169/37 |
| 5,094,298 | A | | 3/1992 | Polan | 169/41 |
| 5,234,059 | A | * | 8/1993 | Eynon | 169/39 |
| D348,719 | S | * | 7/1994 | Dolan | D23/214 |
| 5,366,022 | A | * | 11/1994 | Meyer et al. | 169/37 |

(Continued)

FOREIGN PATENT DOCUMENTS

| | | | |
|---|---|---|---|
| FR | 762 572 | 4/1934 | 7/3 |

(Continued)

OTHER PUBLICATIONS

Communication under Rule 71(3) EPC; EP Application No. 07115611.1-1258; Apr. 8, 2010.

*Primary Examiner* — Dinh Nguyen

(74) *Attorney, Agent, or Firm* — Fitzpatrick, Cella, Harper & Scinto

(57) ABSTRACT

An upright fire protection sprinkler having an input orifice at an input end of the sprinkler for receiving fluid and an output orifice at an output end of the sprinkler for outputting fluid. The sprinkler has a connection portion at the input end of the sprinkler and a body extending between the connection portion and the output end. A pair of frame arms extends from the output end and meets at a hub positioned in axial alignment with the output orifice. A deflector is positioned on the hub and is configured to direct fluid output from the output orifice substantially in a direction back toward the output end.

16 Claims, 4 Drawing Sheets

U.S. PATENT DOCUMENTS

| | | | | | |
|---|---|---|---|---|---|
| 5,609,211 | A | * | 3/1997 | Meyer et al. | 169/37 |
| 5,628,367 | A | * | 5/1997 | Truax et al. | 169/37 |
| 5,632,339 | A | * | 5/1997 | Fenske et al. | 169/37 |
| 5,775,431 | A | | 7/1998 | Ondracek | 169/37 |
| 5,826,665 | A | * | 10/1998 | Truax et al. | 169/38 |
| 5,829,684 | A | * | 11/1998 | Fishcer | 239/524 |
| 5,839,667 | A | * | 11/1998 | Fishcer | 239/498 |
| 5,862,994 | A | * | 1/1999 | Pounder et al. | 239/498 |
| 6,059,044 | A | * | 5/2000 | Fischer | 169/37 |
| 6,182,767 | B1 | * | 2/2001 | Jackson | 169/16 |
| 6,336,509 | B1 | * | 1/2002 | Polan et al. | 169/37 |
| 6,585,054 | B1 | | 7/2003 | Thomas et al. | 169/37 |
| 6,868,917 | B2 | * | 3/2005 | Meyer et al. | 169/37 |
| 6,976,543 | B1 | | 12/2005 | Fischer | 169/37 |
| 7,036,603 | B2 | * | 5/2006 | Thomas et al. | 169/37 |
| 2003/0079889 | A1 | * | 5/2003 | Meyer et al. | 169/37 |
| 2005/0072580 | A1 | * | 4/2005 | Jackson | 169/16 |
| 2006/0060361 | A1 | * | 3/2006 | Pounder et al. | 169/37 |
| 2006/0113093 | A1 | * | 6/2006 | Silva | 169/37 |

FOREIGN PATENT DOCUMENTS

| | | |
|---|---|---|
| WO | WO 00/16855 | 3/2000 |

* cited by examiner

FIG. 6A

Sprinkler With Extended Body

| Pipe Dia. | Pipe OD (S) | W | H | α | S' | △ S |
|---|---|---|---|---|---|---|
| 2" | 2.375" | 1.1" | 6.1" | 7° | 2.09" | -12% |
| 3" | 3.5" | 1.1" | 7.0" | 7° | 2.30" | -34% |
| 2" | 2.375" | 1.2" | 6.1" | 8° | 2.39" | 1% |
| 3" | 3.5" | 1.2" | 7.0" | 8° | 2.64" | -25% |

FIG. 6B

Conventional Sprinkler Without Extended Body

| Pipe Dia. | Pipe OD (S) | W | H | α | S' | △ S |
|---|---|---|---|---|---|---|
| 2" | 2.375" | 1.5" | * 4.8" | 12° | 2.68" | 13% |
| 3" | 3.5" | 1.5" | * 5.5" | 12° | 3.01" | -14% |
| 2" | 2.375" | 1.5" | 7.0" | 12° | 3.66" | 54% |
| 3" | 3.5" | 1.5" | 7.0" | 12° | 3.66" | 5% |

* no sprig-up

FIG. 7

Projected Shadow

| | Pipe Dia. | Pipe OD | W | Hc | α | Sc |
|---|---|---|---|---|---|---|
| Conventional | 2" | 2.375" | 1.5" | 36.0" | 12° | 16" |
| Ext. Body | 2" | 2.375" | 1.2" | 36.0" | 8° | 11" |

AUTOMATIC FIRE PROTECTION SPRINKLER WITH EXTENDED BODY

BACKGROUND OF THE INVENTION

1. Field of the Invention

The present invention relates to an automatic fire protection sprinkler, and in particular an upright sprinkler having an extended body.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb or fusible link, and may also include a latching mechanism.

Certain conventional sprinklers have a pair of arms that extend from the base portion and meet at a hub portion to form a frame. The hub portion is spaced apart from the output orifice of the base portion and is aligned with a longitudinal axis thereof. The hub portion may have a set-screw configured to apply a pre-tension force to the release mechanism. A deflector may be mounted on the hub, transverse to the output orifice, to provide dispersion of the output fluid.

Fire protection sprinklers may be mounted on a fluid conduit running along a ceiling and may either depend downward from the conduit, which is referred to as a "pendent" configuration, or may extend upward, which is referred to as an "upright" configuration. Upright sprinklers may be mounted on a "sprig" or "sprig-up", which is a supply line that extends vertically from the fluid conduit to supply a single sprinkler.

A sprig may be formed by attaching a short section of pipe (referred to as a "nipple") to a "tee" or butt-weld branch connection. A tee branch may be formed, for example, by attaching a mechanical tee to the pipe, which has a base that conforms to the pipe and a threaded or grooved portion that extends from the base. A butt-weld branches may be formed, for example, by welding a fitting to the supply pipe, such as a Weldolet® (Bonney Forge, Mount Union, Pa.), which is a forged steel fitting that conforms to the contour of the supply pipe. The sprinkler is installed in a threaded connection at the end of the sprig. In the case of a branch connection having a grooved connection, the section of pipe may be an "adapter nipple", which is grooved at one end and a threaded port at the other end for receiving the threaded end of the sprinkler.

One of the disadvantages of the conventional sprig configuration is that it requires the use of a separate pipe section for each sprinkler, which increases the number of components in the system. This also adds to installation time, because it requires the separate steps of connecting the pipe section to the branch and connecting the sprinkler to the pipe section. This configuration also increases the probability of leakage, because it doubles the number of connections between the sprinklers and the conduits (i.e., it requires two connections per sprinkler). Furthermore, conventional upright sprinkler bodies are not configured to accommodate a grooved connection without an adapter.

Sprinklers generally may be categorized as "control mode" or "suppression mode". Control mode sprinklers are designed to limit the size of a fire by distribution of water, so as to decrease the heat release rate and pre-wet adjacent combustibles, while controlling ceiling gas temperatures to avoid structural damage. Suppression mode sprinklers are designed to sharply reduce the heat release rate of a fire and prevent its regrowth by means of direct and sufficient application of water through the fire plume to the burning fuel surface.

The thermal sensitivity of a sprinkler is a measure of the rapidity with which thermally-responsive release mechanism operates as installed in a specific sprinkler or sprinkler assembly. One measure of thermal sensitivity is the response time index (RTI) as measured under standardized test conditions. Sprinklers defined as fast response have a thermal element with an RTI of 50 $m\text{-}s^{1/2}$ or less. Sprinklers defined as standard response have a thermal element with an RTI of 80 $m\text{-}s^{1/2}$ or more.

"Specific application control mode storage" sprinklers, as defined in UL 199 ("Standard for Automatic Sprinklers for Fire-Protection Service," Underwriters' Laboratories, $11^{th}$ Ed., Nov. 4, 2005), are designed for the protection of stored commodities, as specified in NFPA 13 ("Standard for the Installation of Sprinkler Systems," National Fire Protection Association, Inc., 2002 Edition), or particular end use limitations specified for the sprinkler (e.g., specific hazards or construction features). According to Section 3.6.2.12 of NFPA 13, a specific application control mode sprinkler (for storage use) is a type of spray sprinkler listed at a minimum operating pressure with a specific number of operating sprinklers for a given protection scheme. Such sprinklers may be used to protect storage of Class I through Class IV commodities, plastic commodities, miscellaneous storage, and other storage as specified in Chapter 12 of NFPA 13 (see Section 12.1.2.3).

Sections 8.5 and 8.6 of NFPA 13 specify requirements for the installation of standard pendent and upright sprinklers. In particular, Section 8.6.5.2.1.3 specifies requirements for the spacing of standard upright sprinklers with respect to obstructions that may interfere with the sprinkler spray pattern. However, as indicated in Section 8.6.5.2.1.8, these spacing requirements do not apply to upright sprinklers that are directly attached, i.e., attached without a sprig-up, to a supply pipe having a diameter of less than 3 inches. Thus, sprinklers that are designed to be installed without sprig-ups have the advantage of less stringent spacing requirements.

Sections 8.5 and 8.11 specify requirements for the installation of special application control mode sprinklers for storage applications. Section 8.11.5 specifies requirements for installation of special application control mode sprinklers near obstructions that may interfere with the sprinkler spray pattern. Section 8.11.5.2.2 states that sprinklers are permitted to be attached directly to branch lines less than 2 inches in diameter. Sprinklers may be directly attached to larger diameter branch lines, as well. However, certain minimum distances apply to the use of sprig-ups (or "riser nipples"). Specifically, sprinklers supplied by a riser nipple must elevate the sprinkler deflector a minimum of 13 inches from the centerline of a 2.5 inch pipe and a minimum of 15 inches from the centerline of a 3 inch pipe. Thus, sprinklers that are designed to be installed without sprig-ups have the advantage of allowing more flexibility in installation.

SUMMARY OF THE INVENTION

In one aspect, the present invention provides an upright fire protection sprinkler having an input orifice at an input end of the sprinkler for receiving fluid and an output orifice at an output end of the sprinkler for outputting fluid. A body extends between the input orifice and the output orifice, the body having a connection portion at the input end and an extended portion. A pair of frame arms extends from the output end and meets at a hub positioned in axial alignment with the output orifice. A deflector is positioned on the hub and is configured to direct fluid output from the output orifice substantially in a direction back toward the output end.

Embodiments of the present invention may include one or more of the following features.

A length of the extended portion may be at least as long as the connection portion and/or at least about 1.2 inches.

The body may have a circumferential groove positioned above the connection portion for receiving a grooved coupling.

The body may have a wrench boss positioned above the connection portion, and the connection portion may be threaded. The wrench boss may be positioned substantially closer to the input end than to the output end.

The input orifice may have a diameter of 1 inch NPT. The sprinkler may have a K-factor of about 16.8, about 19.6, about 25.2, or greater. The sprinkler may have a release mechanism positioned between the hub and a seal cap to hold the seal cap in place over the output orifice. The release mechanism may include a fusible link or a frangible bulb.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

FIG. 6A is a table summarizing calculated shadowing effects for a sprinkler of the present invention FIG. 6B is a table summarizing calculated shadowing effects for a conventional sprinkler.

FIG. 7 is a table summarizing calculated shadowing effects for a sprinkler of the present invention with respect to stacked commodities.

DETAILED DESCRIPTION OF THE PREFERRED EMBODIMENTS

Figure 1:
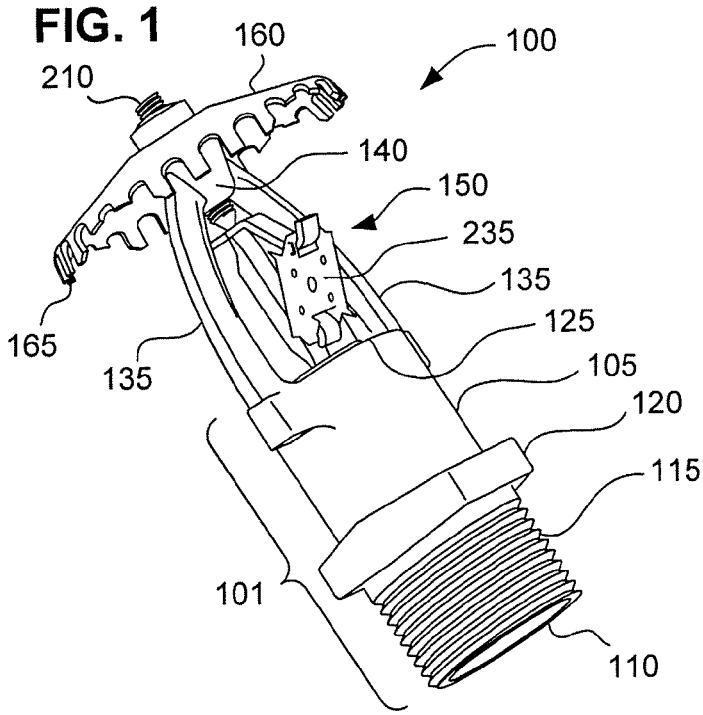
FIG. 1 is a perspective view of an upright sprinkler with extended body, in accordance with the present invention.
Figure 2:
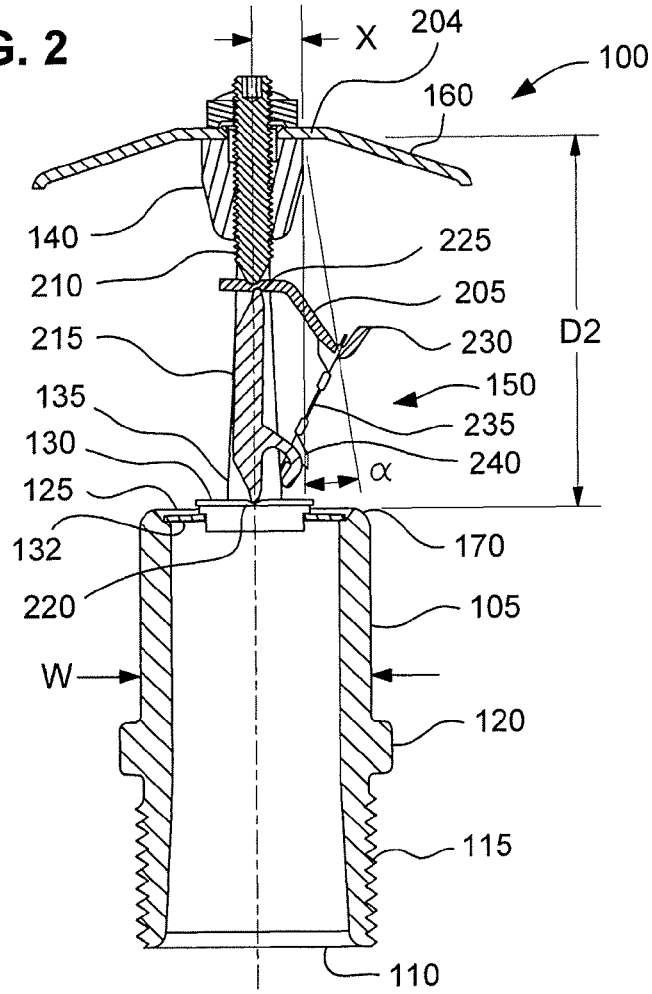
FIG. 2 is a sectional view of the upright sprinkler with extended body in a plane perpendicular to the plane of the frame arms.

FIGS. 1 and 2 show an upright sprinkler 100, in accordance with the present invention, having a cylindrical body 101 defining an axial fluid passage. The body 101 has an input orifice 110 at an input end thereof to receive pressurized fire-extinguishing fluid, such as water, from a conduit (not shown). The body 101 also has an output orifice 125 at an output end thereof.

A threaded connection portion 115 is provided at the input end of the sprinkler 100 to allow the sprinkler to be connected to the conduit for providing the fluid to the fluid passage. A wrench boss 120, which is a circumferential protrusion with flat edges, e.g., a square or hexagonally-shaped protrusion, facilitates the connection of the sprinkler 100 to the supply conduit using a wrench or similar tool. The wrench boss 120 preferably is positioned just above the connection portion 115.

The body 101 has an extended portion 105 that extends between the wrench boss 120 and the output orifice 125. As further discussed below, the extended portion 105 provides an improved sprinkler output pattern by reducing blockage that may be caused by structures that project from the body 101, such as the wrench boss 120.

The input orifice 110 may have a diameter of, for example, 1 inch NPT (national pipe thread). The sprinkler may have a K-factor of, for example, about 19.6, which is defined by $K=Q/\sqrt{p}$, where Q is the flow rate in gallons per minute and p is the residual pressure at the inlet of the sprinkler in pounds per square inch. Other K-factors also are contemplated, such as about 16.8 and higher. The sprinkler may have a maximum spacing of, e.g., 10 feet by 10 feet, a maximum coverage area of, e.g., 100 $ft^2$. and a maximum working pressure of, e.g., 175 psi. Other spacings and coverage areas also are possible, such as, for example, a spacing of 12 feet by 12 feet or 12 feet by 8 feet.

The output orifice 125 is sealed by a seal cap 130 (the seal cap may be surrounded by a flat, ring-shaped spring 132). Two frame arms 135 extend from the output end and meet at a hub 140 positioned in axial alignment with the output orifice 125. As further discussed below, a release mechanism, such as a fusible link assembly 150, is positioned between the hub 140 and the seal cap 130 to hold the seal cap in place over the output orifice 125.

FIGS. 1 and 2 further show that the sprinkler 100 has a release mechanism, e.g., a fusible link assembly 150, having a thermally-responsive element, e.g., a fusible link 235, is positioned between the hub 140 and the seal cap 130 to hold the seal cap in place over the output orifice 125. As shown in the sectional view of FIG. 2, the link assembly 150 includes a lever 205 positioned on a set screw 210 that extends upward from the hub 140. A strut 215 is positioned between the seal cap 130 and the lever 205, such that one end of the strut 215 is positioned in a slot 220 on the surface of the seal cap 130 and the other end of is positioned in a slot 225 on the lever, slightly offset from the set screw 210.

The pressure of the fluid on the seal cap 130 causes a upward force on the strut 215, which in turn causes the extended end 230 of the lever 205 to tend to rotate away from the strut 215 (i.e., the lever 205 rotates counter-clockwise in the view of FIG. 2). The rotational force on the lever 205 creates a tension force on the fusible link 235, which is attached between the extended end 230 of the lever 205 and a hook 240 on the upper portion of the strut 215.

The fusible link 235 comprises two thin, metal plates, e.g., beryllium-nickel alloy, one connected to the lever 205 and the other connected to the strut 215. The plates are joined in an overlapping manner with solder that melts at a predetermined temperature. The link 235 separates at the predetermined temperature, due to the tension force applied by the lever 205 and the strut 215, allowing the lever 205 and the strut 215 to swing outward. This in turn releases the seal cap 130 and allows the fluid to be output from the orifice 125. Of course, other types of release mechanisms may be used, including, but not limited to, for example, a frangible bulb or a sensor, strut, and lever assembly.

A deflector 160 is positioned on the hub 140, so as to be impinged by the output fluid upon activation of the sprinkler 100 and to direct the water in the downward direction, toward the area being protected below the sprinkler 100. The deflector 160 in this particular embodiment is a conical disk that is centered on and orthogonal to the axis of the fluid passage, with the concave side facing the output orifice 125. The disk has a number of teeth 165 of varying length and shape arrayed around its periphery.

A portion of the output fluid deflected downward by the deflector 160 may impinge the top edge 170 of the body 101, creating a shadow of lower output density below the sprinkler 100. As shown in FIG. 2, a shadow angle (α) may be defined between the top edge 170 of the body 101 and the vertical direction, the angle (α) having a vertex at a point 204 at which the underside of the deflector 160 meets the top edge of the hub 140. The shadow angle (α), which is calculated from the dimensions of the sprinkler 100, provides a theoretical estimate of the size of the conically shaped region of lower output density below the sprinkler.

The shadow angle (α) may be calculated as follows. A dimension, D2, defined between the underside of the deflector 160 and the top edge 170 of the body 101, may be, for example, about 2 inches (and in certain embodiments may be about 2.06 inches). The body 101 may have a diameter (W) of greater than about 1.1 inches and preferably about 1.2 inches. The hub 140 has a radius, X, of between about 0.125 inches and about 0.325 inches and preferably about 0.3 inches. The shadow angle (α) is given by:

$$\alpha=\arctan\,[(W/2)-X)/D2].$$

For an embodiment in which D2=2.06 inches, X=0.3 inches, and W=1.2 inches, the shadow angle (α) would be about 8°. In other embodiments, the shadow angle (α) may be between about 6° and about 13°. As noted above, the cylindrical sprinkler body 101 has an extended portion 105 that extends above the wrench boss 120. Thus, the shadow angle (α) is defined by the diameter (W) of the extended portion 105, rather than the width of the wrench boss 120. This results in a reduced shadow angle (α) compared to a conventional sprinkler, such as the one shown in FIG. 3, discussed below, for which the wrench boss 320 defines the top edge 330 of the sprinkler.

The sprinkler 100 may have a total height of about 4.6 inches, as measured from the input orifice 110 to the top of the deflector 160, in which case the body 101 would have a length of about 1.2 inches (as measured from the top edge of the wrench boss 120 to the top edge 170 of the sprinkler body 101). In other embodiments, the sprinkler body 101 may have a length between about 1.25 inches to about 1.5 inches.

Figure 3:
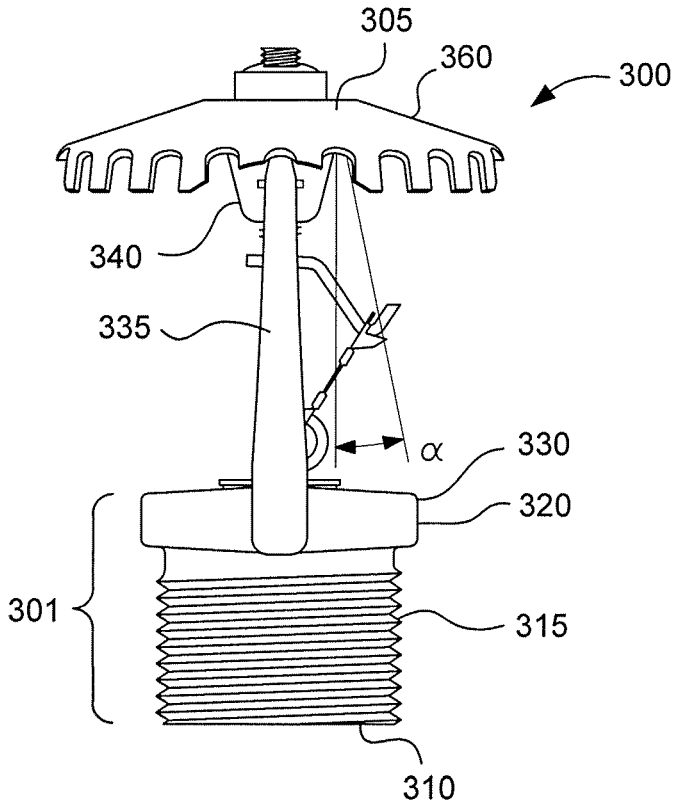
FIG. 3 is a side view of a conventional upright sprinkler without an extended body.

FIG. 3 shows a conventional upright sprinkler 300 having a body 301 with a threaded portion 315 at an input end and a wrench boss 320 positioned immediately above the threaded portion 315 at an output end of the body 301. The body 301 does not extend above the wrench boss 320.

As above, a shadow angle (α) may be defined between the top edge 330 of the sprinkler 300 and the vertical direction, the angle (α) having a vertex at a point 305 at which the underside of the deflector 360 meets the edge of the hub 340 (the underside of the deflector is not visible in the view of FIG. 3, so the approximate location of point 305 is indicated). The top edge 330 of the body 301 is defined by the wrench boss 320, which is wider than the rest of the sprinkler, thereby resulting in an increased shadow angle (α). For example, the wrench boss 320 may have a width of 1.5 inches, while the portion of the sprinkler below the wrench boss 320 has a diameter of 1.2 inches.

A conventional sprinkler having a wrench boss width of 1.5 inches, with other dimensions similar to the embodiment of FIG. 2, would have a shadow angle (α) of 12°, as opposed to 8° for the configuration of FIG. 2. This results in a significantly larger region of shadow beneath the sprinkler. Moreover, the shadow angle (α) of the conventional sprinkler 300 varies around the circumference of the body 301 in correspondence with the shape of the wrench boss 320. Thus, in the case of a square wrench boss 320, the shadow angle (α) of the conventional sprinkler 300 at the corners of the wrench boss 320 would be greater than 12°.

Figure 4:
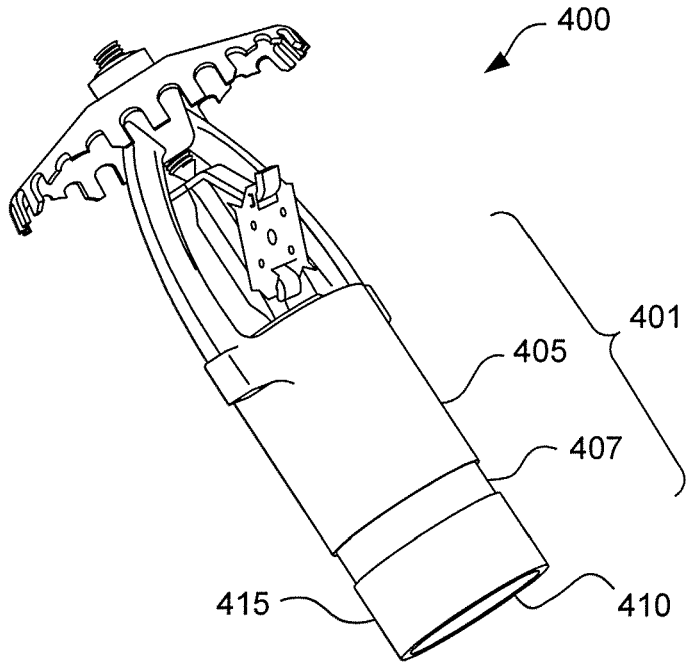
FIG. 4 is a perspective view of the upright sprinkler with an extended body configured for a grooved connection.

FIG. 4 shows an embodiment of the upright sprinkler 400 having a body 401 configured to be installed using a grooved connection. A circumferential groove 407 is positioned near the input end of the body, e.g., approximately 0.6 inches from the input end. The body 401 has a connection portion 415 below the groove and an extended portion 405 extending above the groove 407. To make a grooved connection, the connection portion 415 of the sprinkler is abutted (or brought in close proximity to) to the end of a branch connection (not shown) having a similar groove. A grooved coupling, shaped like an elongated "C", is attached around the abutted ends of the sprinkler and branch. The coupling fits into the groove 407 of the sprinkler and the groove of the branch to hold these components together. The coupling sits over a gasket that surrounds the ends of the components to prevent leakage.

The configuration of FIG. 4 is advantageous in that it does not require a wrench boss and therefore does not have the problem of increased shadowing, as discussed above with respect to FIG. 3. Thus, the configuration shown would have a shadow angle (α) similar to the embodiment shown in FIG. 2 (about 8°). Additionally, the groove coupling allows for convenient installation, without the use of sprig-ups. A conventional sprinkler, by contrast, would require an adapter to connect to be connected using a grooved coupling.

Figure 5:
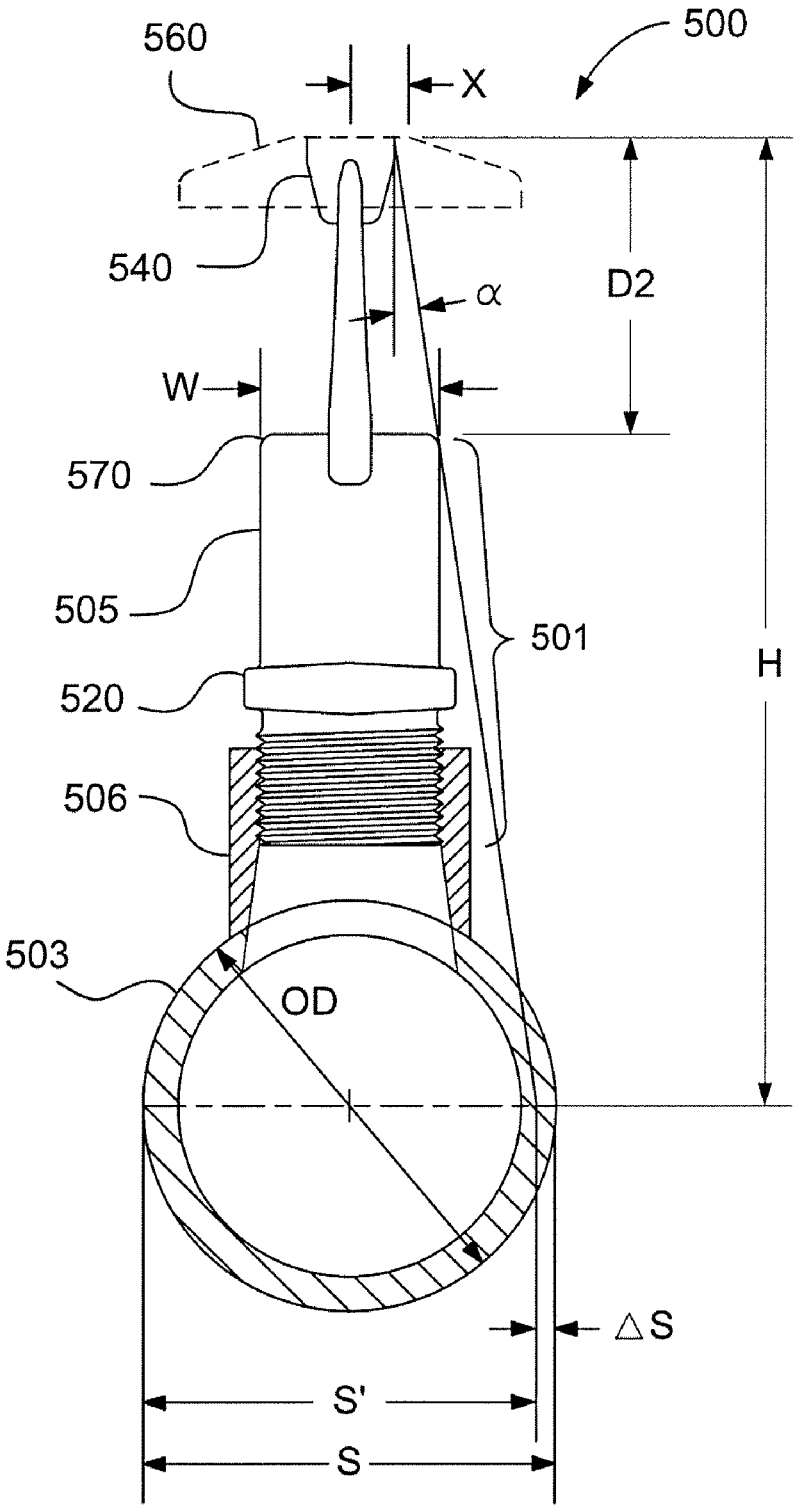
FIG. 5 is a side view of the upright sprinkler mounted on a supply conduit.

FIGS. 5-7 present theoretical calculations comparing the upright sprinkler of the present invention to a conventional sprinkler (both with and without a sprig-up). These calculations are based on the dimensions of the sprinkler and the supply pipe and the connection between them, e.g., a branch connection.

FIG. 5 shows an upright sprinkler 500 having a body 501 with an extended portion 505, in accordance with the present invention, mounted on a supply pipe 503 using a threaded branch connection 506. The supply pipe 503 has a nominal inner diameter of, for example, 2" or 3" and an outer diameter (OD) of 2.375" or 3.5", respectively. The branch connection in this example has a height of 1.25" and a diameter of 1.90", and it may be used on either 2" or 3" supply pipes. As discussed above, a dimension, D2, may be defined between the underside of the deflector 560 and the top edge 570 of the body 501. The top edge 570 of the sprinkler body 501 has a diameter (W), and the hub 540 has a radius, X. A height, H, may be defined between the top of the deflector 560 and a center line of the supply pipe 503.

For comparison purposes, a similar set of dimensions may be defined for a conventional sprinkler positioned on a supply pipe. In such case, the diameter, W, is defined by the width of the wrench boss (i.e., the distance between the flat edges of the wrench boss), which forms the top edge of the conventional sprinkler. The desired height, H, may be achieved by using a sprig-up, which may various configurations of pipe sections and adapters.

A shadow diameter, S, may be defined, which corresponds to the diameter of the conical-shaped, shadowed region at a particular distance beneath the sprinkler. To account for shadowing caused by the supply pipe 503 (as opposed to the structure of the sprinkler), the shadow diameter (S) is considered to have a baseline value corresponding to the diameter (OD) of the supply pipe 503. The baseline value may change, by an amount defined as ΔS, depending upon the particular dimensions of the sprinkler, as discussed below. The resulting composite shadow diameter (S'), which is based on the dimensions of the supply pipe and the sprinkler, is given by the expression: S'=S+ΔS. The value of S' may be less than, equal to, or greater than the baseline shadow diameter (S).

FIG. 6A presents calculated results for a sprinkler of the present invention mounted on a 2" or 3" supply pipe (as shown in FIG. 5). For these examples, D2=2.06 inches and X=0.3 inches. The height (H) measured from the center line of the supply pipe to the top of the deflector is either 6.1" or 7", depending upon the supply pipe diameter (the height of the sprinkler is about 4.6 inches in both cases). Two values of body diameter (W) are considered, 1.1" or 1.2", resulting in a shadow angle (α) of 7° or 8°, respectively.

In the examples of FIG. 6A, the baseline shadow diameter (S) is equal to the pipe outer diameter (OD). The composite shadow diameter, S', is calculated from:

$$S'=2(H\tan\alpha+X).$$

The differential shadow diameter, ΔS, is expressed as a percentage of the baseline shadow diameter (S):

$$\Delta S=(S'-S)/S.$$

As shown in FIG. 6A, the sprinkler in accordance with the present invention generally provides a composite shadow diameter (S') that is equal to or less than the baseline shadow diameter (S), i.e., ΔS is negative or about zero. This is advantageous in that it does not increase the shadow caused by the supply pipe, thereby maintaining the minimum shadow diameter for a given combination of supply pipe OD and sprinkler height.

Furthermore, having a composite shadow diameter (S') less than the supply pipe OD, i.e., a negative value of ΔS, results in a portion of the sprinkler output being directed onto the surface of the pipe ("pipe wash"). The pipe wash is carried around the surface of the pipe by natural adhesive forces and leaves the lower surface of the pipe, due to gravitational forces. Thus, the pipe wash ends up falling within the shadow of the supply pipe, i.e., within the baseline shadow diameter, S. This helps increase the density of output fluid beneath the supply pipe, thereby improving the fire control capabilities of the sprinkler.

FIG. 6B presents calculated results for a conventional sprinkler mounted on a 2" or 3" supply pipe. The dimension W defines the width of the top edge of the sprinkler, which is determined by the width of the wrench boss (1.5"). As above, D2=2.06 inches and X=0.3 inches. The height (H) measured from the center line of the supply pipe to the top of the deflector is 7", including a sprig-up. For comparison purposes, examples are presented for a conventional sprinkler without a sprig-up, in which case the height is either 4.8" or 5.5", depending upon the supply pipe diameter (the height of the sprinkler is 2.8 inches in both cases). Generally speaking, a sprig-up will be used in most conventional configurations.

As shown in FIG. 6B, the composite shadow diameter (S') is greater than the supply pipe OD, i.e., ΔS is a positive value, for the 7" height. In fact, for the 2" supply pipe, the composite shadow diameter (S') is 50% greater than the shadow due to the supply pipe alone (S).

FIG. 7 illustrates an effect of an increased composite shadow diameter (S') on the fire control properties of a sprinkler. In storage applications, the commodities to be protected are positioned a particular distance below the sprinkler and have a particular configuration. For example, suppose boxed commodities are stored up to a height that is 3 feet below the top of the deflector (Hc=36 inches), and the sprinkler is centered in a gap between the boxes of 12 inches. The shadow diameter projected onto the commodities (Sc) would be 16" for the conventional sprinkler, versus 11" for the sprinkler according to the present invention. This means that the output pattern of the conventional sprinkler would largely be outside the gap between the boxes, so the inner edge of the conical shadow would wash over the boxes. By contrast, the inner edge of the conical shadow for the present invention would fall within the gap between boxes, thereby delivering fluid into that gap and providing better fire control.

It is contemplated that the present invention may be used, for example, as a specific application control mode sprinkler for storage applications. In accordance with UL 199, storage sprinklers (referred to as area/density sprinklers) are tested in a large scale fire test, in which an array of sprinklers is installed over predetermined configurations of commodities. The present invention is designed to protect single, double, multiple-row, or portable row rack commodities in Classes I-IV, including Group A or B plastics, and solid pile configurations of these commodities. The present invention is also designed to protect uncartoned (exposed) unexpanded plastics (rack and solid pile), cartoned expanded plastics (rack and solid pile), and idle pallet storage (wood or plastic and both rack and floor). The present invention is designed for building heights ranging from about 30' to about 45', with corresponding storage heights of about 25' to about 40', and pressure/flow of about 15 psi/76 gpm to about 30 psi/107 gpm.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. An upright fire protection sprinkler, comprising:

a sprinkler body, having an input orifice at an input end of the sprinkler for receiving fluid and an output orifice at an output end of the sprinkler for outputting the fluid, the body having a connection portion at the input end and an extended portion extending between the connection portion and the output end, wherein the extended portion is at least as long as the connection portion;

a pair of frame arms extending from the output end and meeting at a hub positioned in axial alignment with the output orifice, wherein the frame arms are integrally formed with the body; and a deflector positioned on the hub and configured to direct the fluid output from the output orifice substantially in a direction back toward the output end, wherein the width of the extended portion, measured in a plane perpendicular to a plane passing through the frame arms, is substantially uniform along the length of the extended portion.

2. The upright fire protection sprinkler of claim 1, wherein the length of the extended portion is at least about 1.2 inches.

3. The upright fire protection sprinkler of claim 1, further comprising a circumferential groove positioned between the connection portion and the extended portion, the groove constructed to receive a grooved coupling.

4. The upright fire protection sprinkler of claim 3, wherein the length of the extended portion is at least as long as the connection portion.

5. The upright fire protection sprinkler of claim 3, wherein the length of the extended portion is at least about 1.2 inches.

6. The upright fire protection sprinkler of claim 1, further comprising a wrench boss positioned between the connection portion and the extended portion, wherein the connection portion comprises threads.

7. The upright fire protection sprinkler of claim 6, wherein the length of the connection portion is at least about 1.2 inches.

8. The upright fire protection sprinkler of claim 6, wherein the wrench boss is positioned substantially closer to the input end than to the output end of the body.

9. The upright fire protection sprinkler of claim 1, wherein the input orifice has a diameter of 1 inch NPT.

10. The upright fire protection sprinkler of claim 1, wherein the sprinkler has a K-factor of about 16.8 or greater.

11. The upright fire protection sprinkler of claim 1, wherein the sprinkler has a K-factor of about 19.6 or greater.

12. The upright fire protection sprinkler of claim 1, wherein the sprinkler has a K-factor of about 25.2 or greater.

13. The upright fire protection sprinkler of claim 1, further comprising a release mechanism positioned between the hub and a seal cap to hold the seal cap in place over the output orifice.

14. The upright fire protection sprinkler of claim 13, wherein the release mechanism comprises a fusible link.

15. The upright fire protection sprinkler of claim 13, wherein the release mechanism comprises a frangible bulb.

16. The upright fire protection sprinkler of claim 1, wherein the length of the extended portion is predetermined and a region of lower output density below the sprinkler is defined based on a shadow angle of the fluid output impinging on an outer edge of the extended portion at the output end of the extended portion, wherein the shadow angle is defined as the angle between the axial direction and a line between the outer edge of the extended portion at the output end and a vertex at the intersection of the hub and the deflector.

* * * * *